US005865161A

United States Patent [19]

Bruce

[11] Patent Number: 5,865,161

[45] Date of Patent: Feb. 2, 1999

[54] BASEBALL PITCHING DEVICE

[76] Inventor: Norman R. Bruce, 5055 Dobrot Way, Central Point, Oreg. 97502

[21] Appl. No.: 368,606

[22] Filed: Jan. 4, 1995

[51] Int. Cl.[6] ..... F41B 4/00

[52] U.S. Cl. ..... 124/78

[58] Field of Search ..... 124/78, 6

[56] References Cited

U.S. PATENT DOCUMENTS

| | | | |
|---|---|---|---|
| 2,716,973 | 9/1955 | Desi | 124/78 |
| 2,737,941 | 3/1956 | Carrau | 124/78 |
| 3,538,900 | 11/1970 | Samuels | 124/78 |
| 4,442,823 | 4/1984 | Floyd et al. | 124/78 |
| 4,632,088 | 12/1986 | Bruce | 124/78 |
| 4,712,534 | 12/1987 | Nozato | 124/78 |
| 5,046,476 | 9/1991 | Nozato | 124/78 |

*Primary Examiner*—John A. Ricci
*Attorney, Agent, or Firm*—Richard D. Slehofer

[57] ABSTRACT

The present invention can be described as a ball pitching machine having an integral pitching barrel and motor mount and three spaced drive wheels partially projecting into the barrel to grip and propel a ball placed in one end of the pitching barrel. The barrel has three longitudinally aligned slots or windows in the surface of the barrel to provide clearance for secant portions of each of the three wheels. The planes formed by each drive wheel extend radially from the longitudinal axis of the barrel. Each radial plane is equally spaced from each other at 120 degrees relative to each other. Each domed drive wheel is rotatably mounted on the end of a rotatable drive shaft of an electric motor. The three electric motors are mounted on the integral pitching barrel and mount by C-shaped clamps. The barrel is supported by a wheel mounted frame, a pair of U-shaped brackets secured to the frame in an opposed facing relationship, a front support ring for rotatably securing the ejectment end of said ball pitching device, and a rear support ring for rotatably securing the feed end of the ball pitching device. The front support ring and the rear support ring are mounted in a spaced apart relationship between the opposed facing U-shaped brackets to form a generally open rectangular-shaped support member for rotatably mounting and adjusting vertical angle of the ball pitching machine.

4 Claims, 12 Drawing Sheets

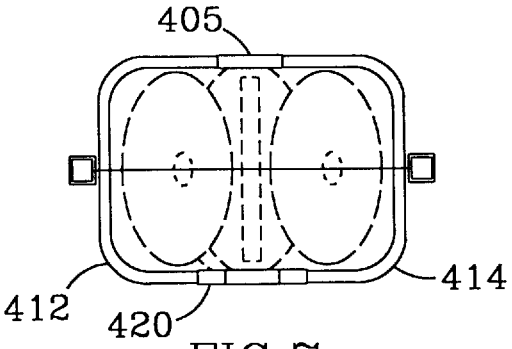
FIG.7
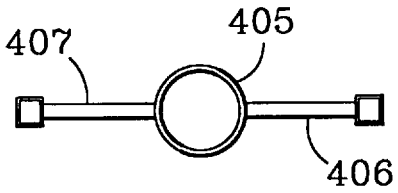
FIG.6
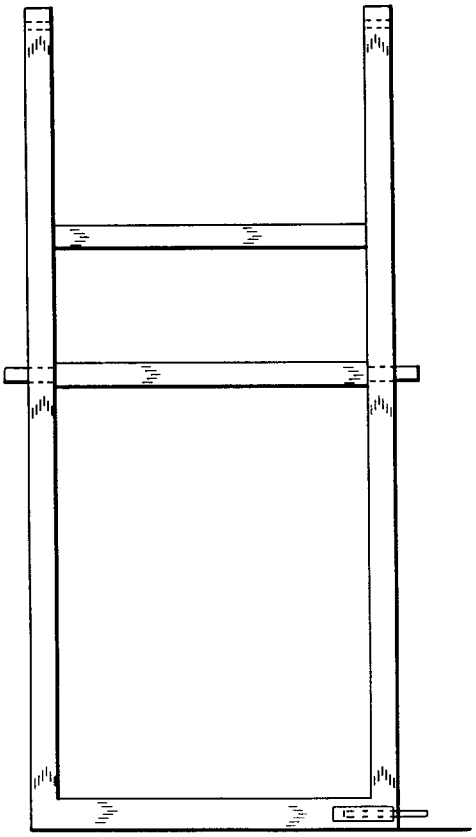
FIG.10
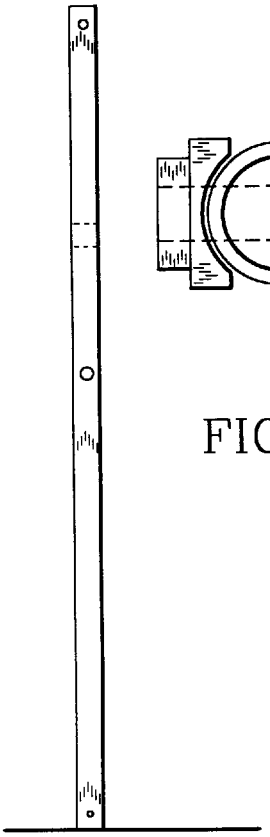
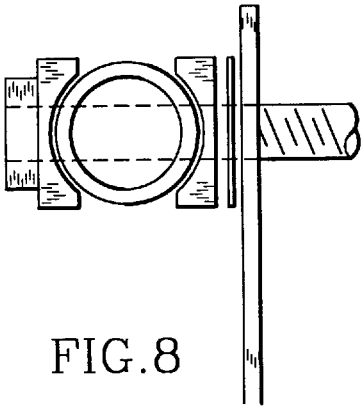
FIG.8
FIG.9

BASEBALL PITCHING DEVICE

CROSS REFERENCE TO RELATED APPLICATIONS none

BACKGROUND OF THE INVENTION

1. Field of the Invention

The present invention pertains to the following areas of technology: mechanical guns and projectors; projectile impelled by coacting wheels.

2. Description of the Prior Art

U.S. Pat. No. 3,774,584 issued in 1973 and U.S. Pat. No. 4,193,591 issued in 1980 both to John Paulson disclose a coacting wheel type ball projecting device having a base member in the form of a metal casting. A pair of opposed rotatable ball ejecting wheels are mounted to the metal casting. The ball is gripped between the two wheels and ejected.

U.S. Pat. No. 4,632,088 issued on Dec. 30, 1986 to Norman R. Bruce discloses a ball throwing apparatus with a barrel and two opposed drive wheels positioned one on each side of the barrel. Both drive wheels are slightly offset and their peripheries positioned in the barrel so that the drive wheels impart a spin to the baseball as it is ejected from the barrel.

U.S. Pat. No. 5,012,790 issued in 1991 to Michael Bates discloses a ball pitching device having a variable speed control for the rotation of the baseball propelling tire.

The present invention is a simplification of known devices made for throwing many different types and sizes of balls. The present invention can also be used to throw various types and sizes of ball, but is preferably used for throwing baseball pitches to the batter that vary greatly in speed, spin, and spin plane. The need for such devices has long been established. Mechanical baseball pitching devices are used all the way from pre-little league teams through individual major league players and teams. The time available for practice is of necessity limited, and the limited time must be used in an efficient and productive manner. To this end, the present invention is a significant improvement over the known pitching devices. The present invention can be quickly adjusted for various pitches. After the present invention is aligned for the target, changes of ball pitches are quickly accomplished electrically and not manually. The electrical adjustment to change the curve and trajectory of the pitched ball is done instantly. Set-up is also minimized, because the present invention can be easily wheeled to the proper position in the field ready to use. It is then oriented to the target with no adjustment or assembly of the legs.

The present invention eliminates set-up time, and it is easily and comfortably wheeled to the point of use and ready for use.

SUMMARY AND OPERATION OF THE INVENTION

The present invention includes three drive wheels for complete control of the trajectory of the ball tossed or ejected by the ball pitching machine. The machine is used to simulate a ball pitched by a baseball pitcher, and the machine is also used to simulate a baseball hit by a batter. It is used on the practice field to automatically pitch balls to batters, and to hit balls to players such as outfielders. The trajectory of the pitched ball is controlled by the rotational speeds of each of the three drive wheels. The machine itself does not have to be rotated. By electrically adjusting the rotational speed of each of the drive wheels, the machine can pitch right curves, left curves, overhead curves, and fast balls for example while never moving the machine. Changing motor speeds is all that is required. The pitched ball has pinpoint accuracy. The present invention saves both time and energy. It can be set up quickly and is easy to operate. The three drive wheels eliminate any tendency for the machine to throw wild pitches. The elevational adjustment on the mounting stand allows the machine to throw ground balls and pop-up flies with a simple adjustment, which can be accomplished in a matter of seconds. Radial rotation of the pitching machine is provided in case the user requires this feature. Trajectory changes of the pitched ball can be made without interfering with the preset target zone. Once the target zone is set, no further adjustment is needed even though many different types of pitches are generated during a practice session.

The present invention also allows for multiple control of the pitches. The user can stand next to the machine and make the adjustments during use. The user can also control the pitches from a remote location. And the user can program the machine to provide a series of pitches. The mounting stand eliminates any limitations on the use of the pitching machine.

An objective of the present invention is the utilization of three drive wheels partially projecting into the pitching barrel to manage speed, spin, and spin plane of a ball pitched by a ball pitching machine. The ball can be pitched accurately, and the type of pitch can be changed without losing the target zone previously set for the pitched balls.

Another objective is to provide pitched balls of many types of throws without the need to radially realign the pitching barrel for each different type of pitched ball even when the trajectory of the pitched ball is changed. This is accomplished by proper adjustment of the rotational speeds of each of the drive wheels. This is not possible in two drive wheel pitching machines.

Yet another of objective of the present invention is to greatly improve the accuracy of the pitched ball by feeding the ball to the drive wheels with a precision guidance feed rails in the pitching barrel. Additionally, three drive wheels grip and throw the ball with much improved accuracy over two wheel machines, and lessens the incidence of wild pitches.

Yet another objective of the present invention is to eliminate adjustment time required of two wheel pitching machines. The present invention can throw a series of different types of pitches without interruption and without loss of target orientation.

Another objective of the present invention is to save time and inconvenience with a pitching stand that can be rolled to and from the practice field with ease and requires no assembly or disassembly.

The present invention can pitch a succession of diverse types of pitches, ground balls, pop-ups and the like without rotation of the pitching barrel. Rotation capability of the pitching barrel is available when needed by the user.

BRIEF DESCRIPTION OF THE DRAWINGS

FIG. 6 is a front view of the front mounting bracket.

FIG. 7 is a top plan view of the mounting bracket shown in FIG. 6.

FIG. 8 is the mounting bracket attachment to the stand, which includes a bolt, radiused segments, and a friction washer.

FIG. 9 is a side view of the upper stand section.

FIG. 10 is a front view of the upper stand section shown in FIGS. 5 and 9.

DETAILED DESCRIPTION OF THE PREFERRED EMBODIMENT

Figure 1:
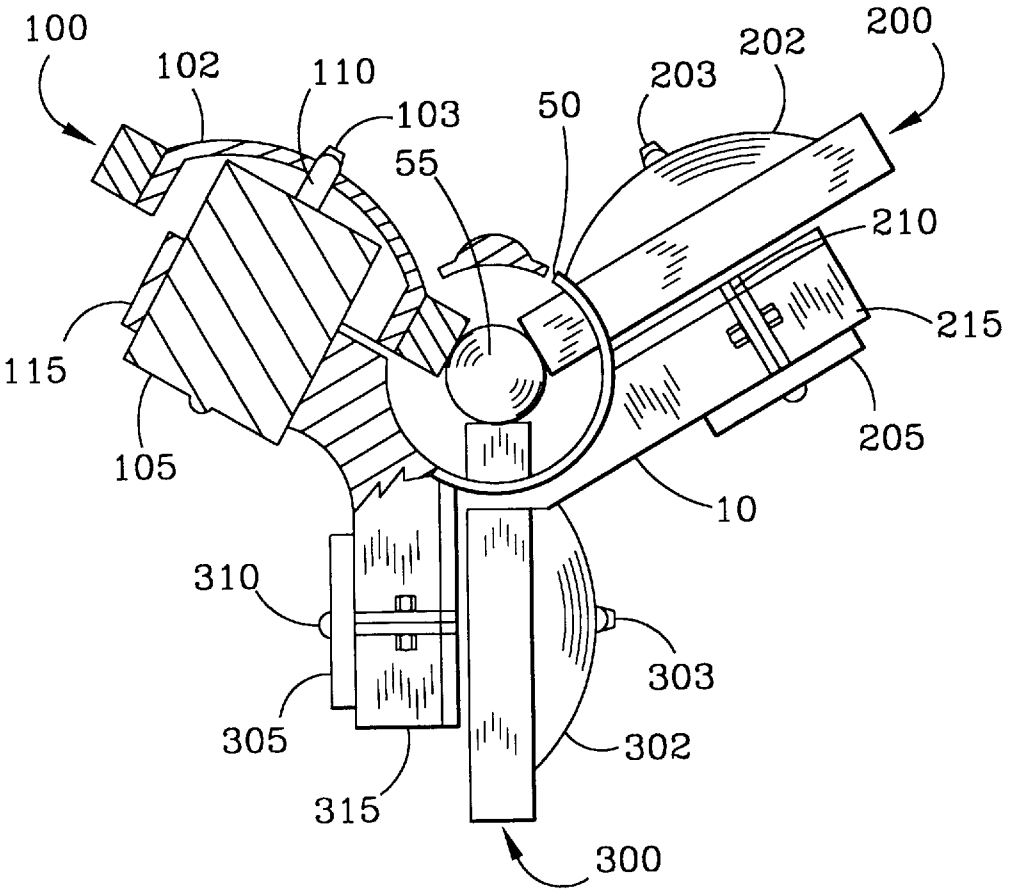
FIG. 1 is a partial fragmentary front elevational view of the present invention showing the three drive wheels mounted on the triplex casting member and integral barrel with the portions of the three wheels projecting into the pitching barrel.
Figure 2:
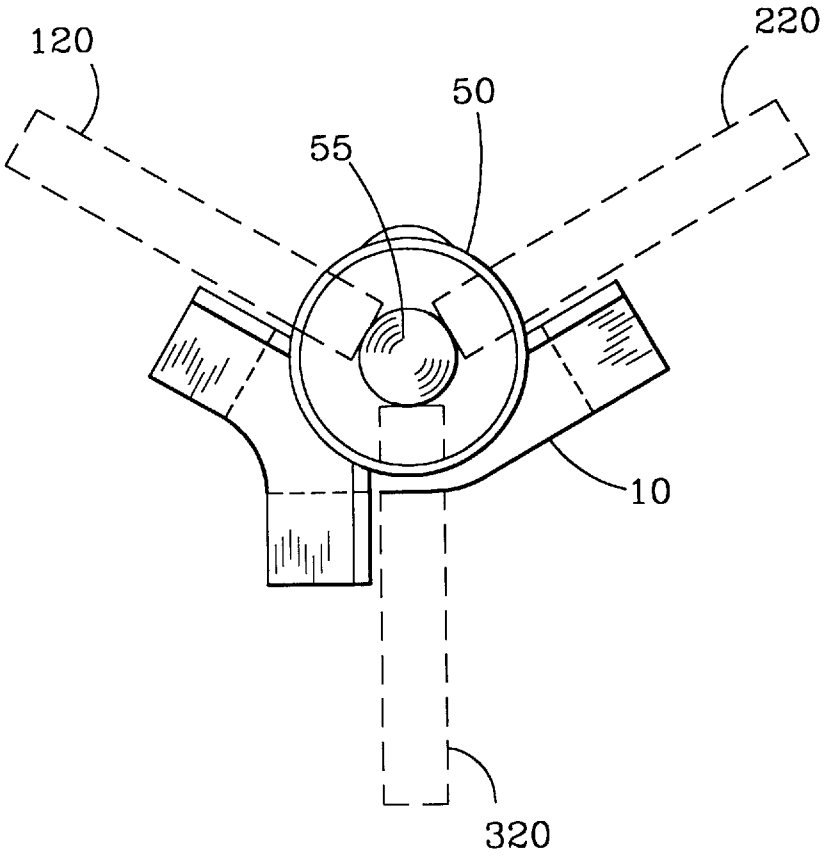
FIG. 2 is a front elevational view similar to FIG. 1 of the present invention showing the triplex casting member with the integral barrel, and the three drive wheels in broken lines.
Figure 3:
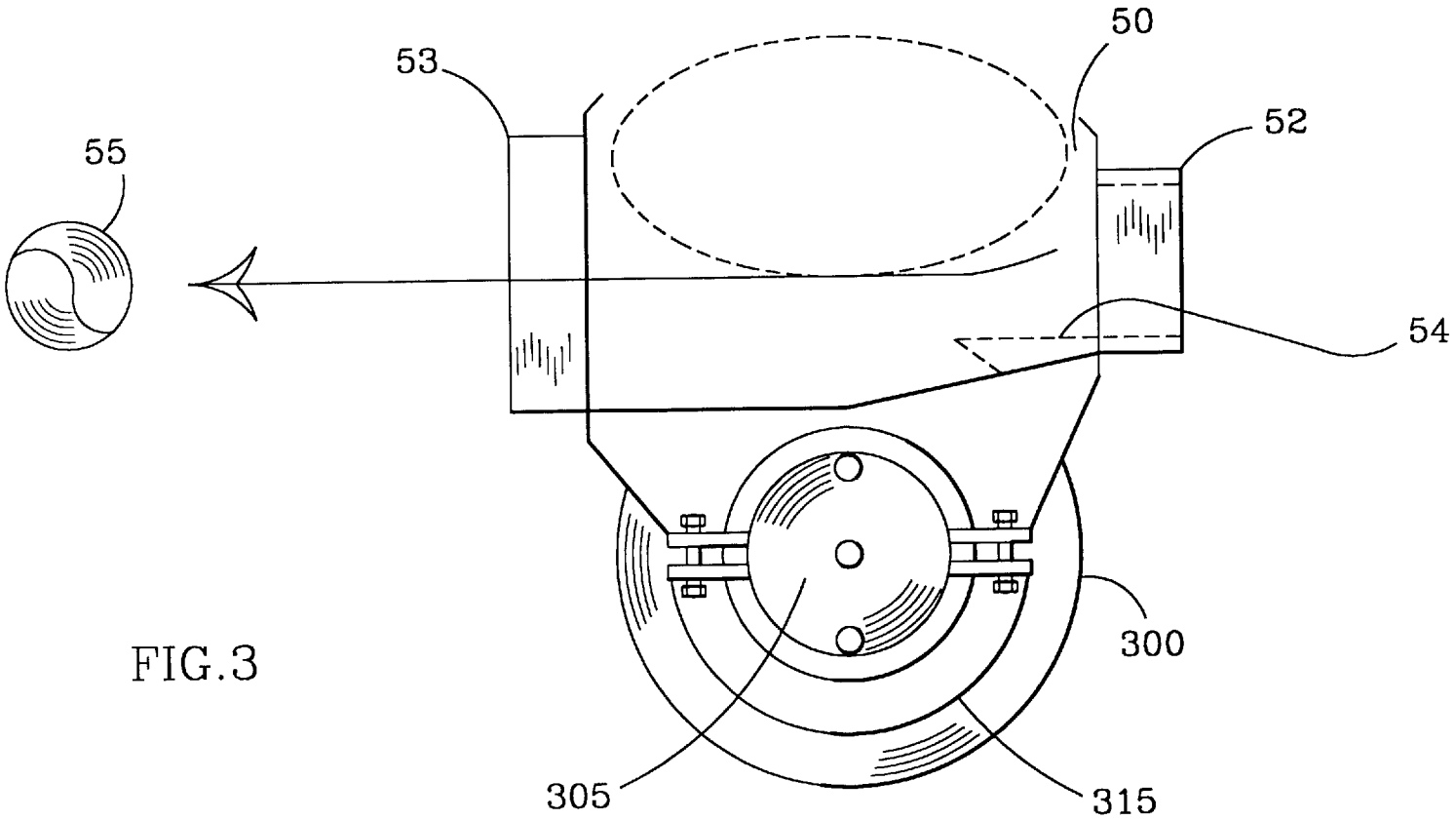
FIG. 3 is a left side elevational view of FIG. 1 of the present invention showing the triplex casting member and integral barrel, and one of the three motors with an attached wheel and a motor retaining cap.

The present invention, which is clearly illustrated in all of the Figures, will now be discussed in greater detail. FIG. 1 illustrates a partial fragmentary front elevational view of the present invention showing the three drive wheels 100, 200, and 300 mounted on the triplex casting member 10 and integral barrel 50 with secant portions of each of the three drive wheels projecting into the pitching barrel 50. FIG. 2 is a front elevational view similar to FIG. 1 of the present invention showing the triplex casting member with the integral barrel in solid lines, and the three drive wheels in broken lines. The profile of each drive wheel 120, 220 and 320 is shown in broken lines in FIG. 2. The electrical motors 105, 205 and 305 are shown in FIG. 1 but not in FIG. 2. Each of the three motors is secured to the member 10 by means of a semi-circular C-shaped clamp that secures and holds the electric motor in place on the casting member 10. FIG. 3 is a left side elevational view of FIG. 1 of the present invention showing the triplex casting member 10 and integral barrel 50, and one of the three motors 305 with an attached wheel 300 and a motor retaining clamp 315.

Figure 4:
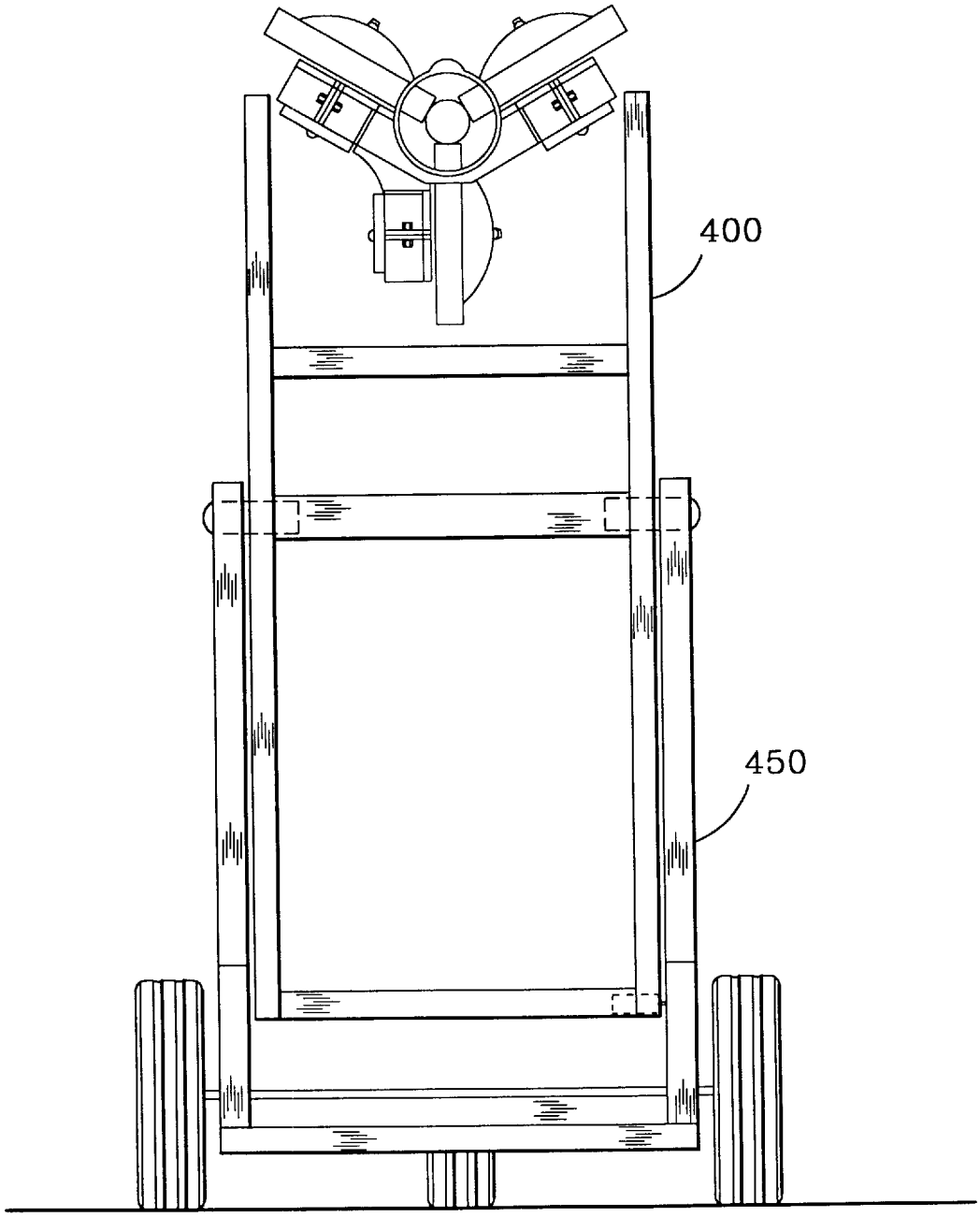
FIG. 4 is a front elevational view of the ball pitching machine mounted on the two component fold-down sectional stand.
Figure 5:
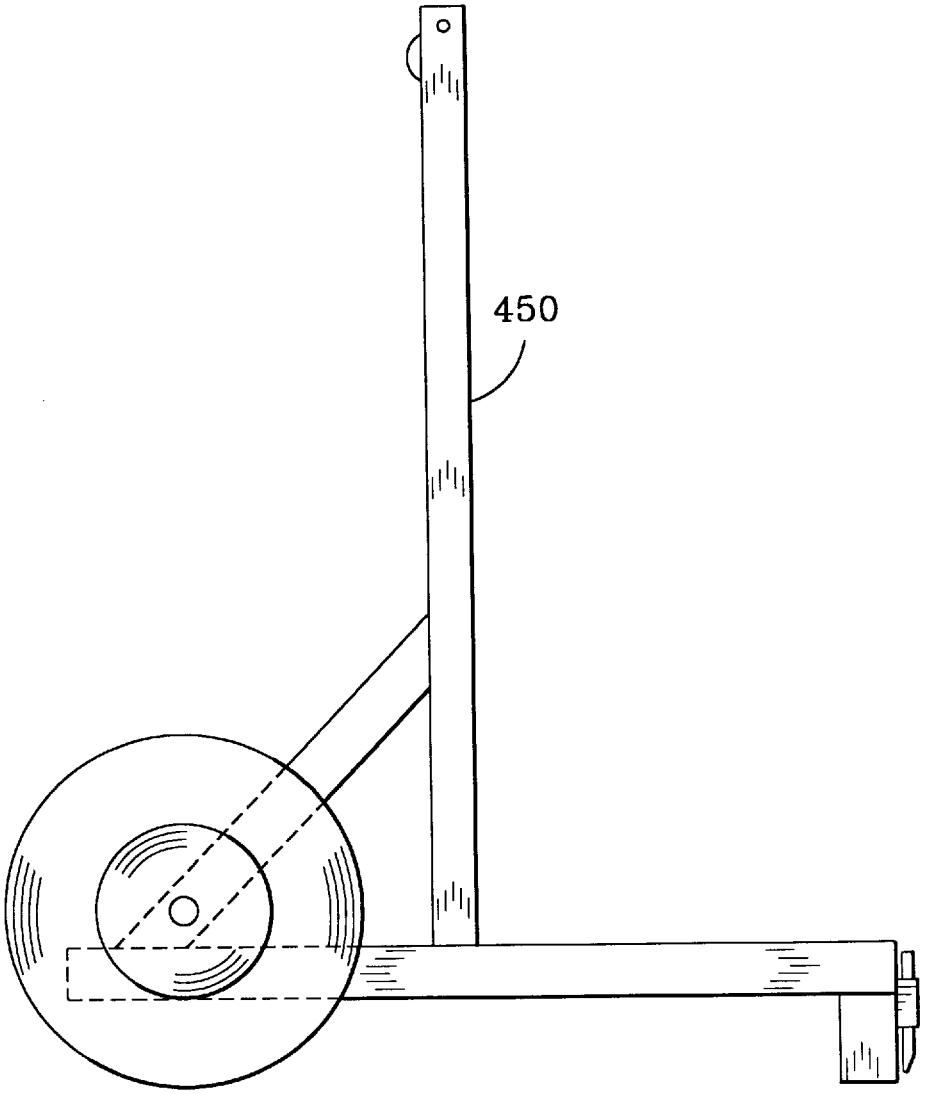
FIG. 5 is a side elevational view of the lower component of the two-piece sectional stand shown in FIG. 4.
Figure 11:
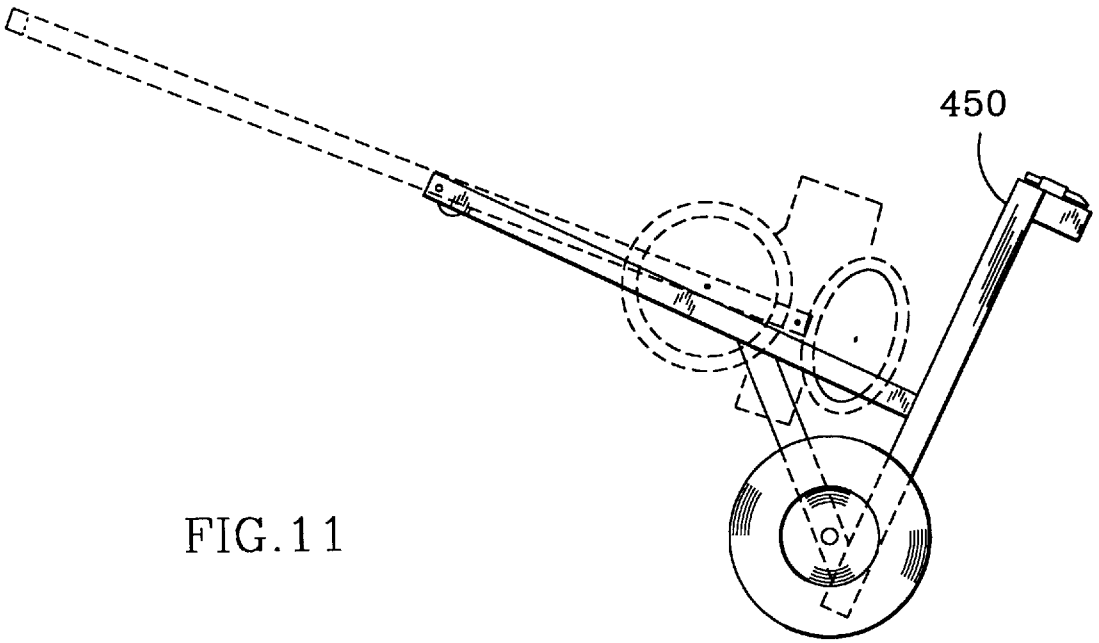
FIG. 11 is a side view of the present invention including the stand in the transport mode.
Figure 13:
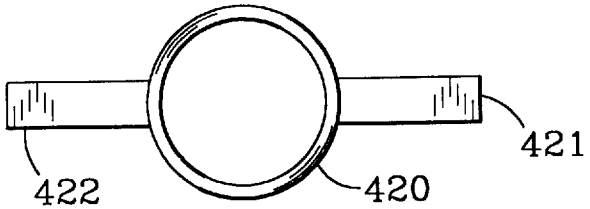
FIG. 13 is the rear mounting ring.
Figure 12:
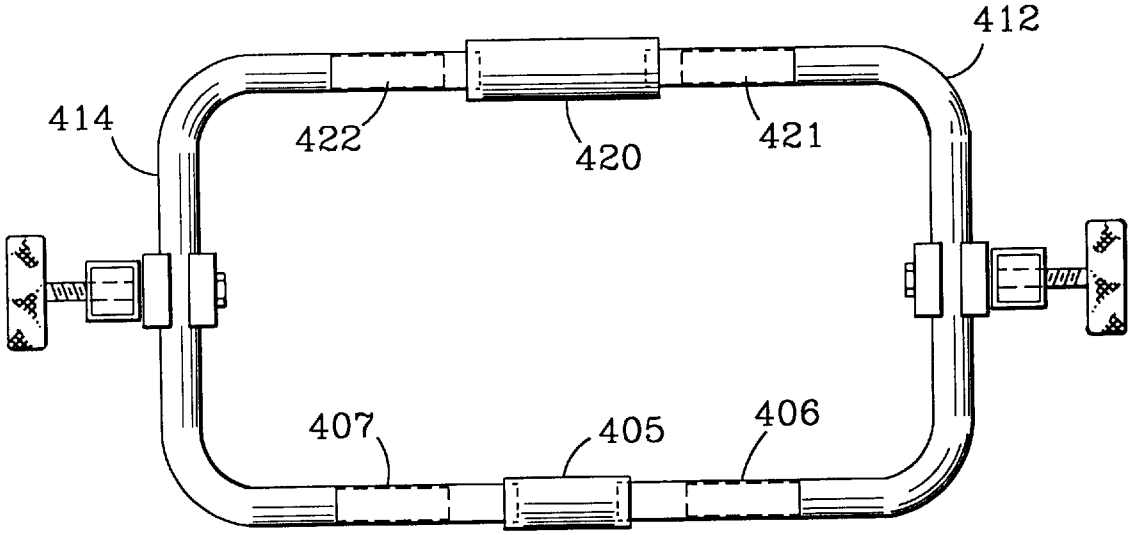
FIG. 12 is a top plan view of the ball pitching machine mounting bracket showing the U-shaped sections that fit together with the front and rear ring sections.
Figure 14:
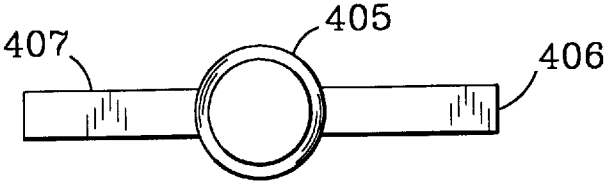
FIG. 14 is the front mounting ring.
Figure 15:
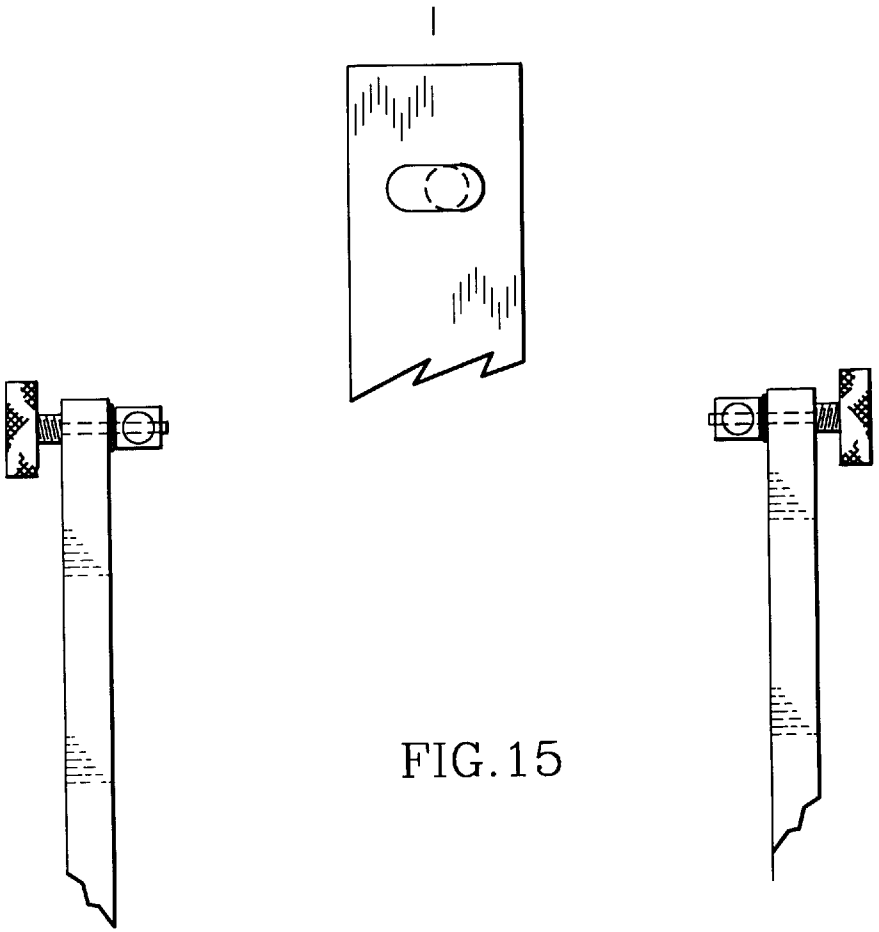
FIG. 15 illustrates front elevational views of the mounting knobs illustrated in FIG. 12.
Figure 16:
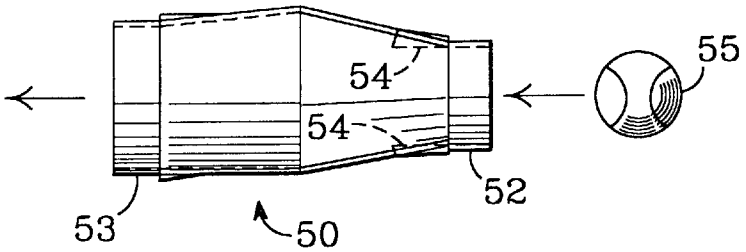
FIG. 16 illustrates the barrel.
Figure 17:
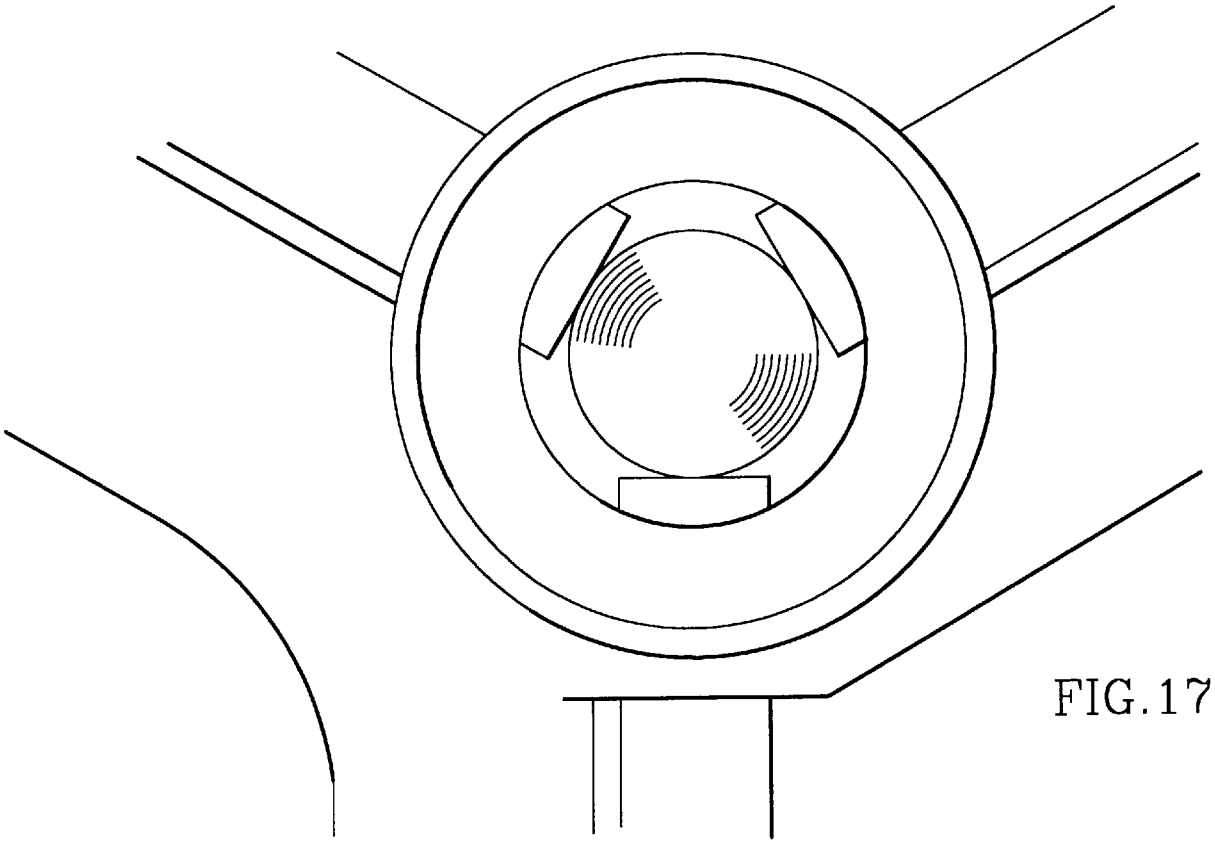
FIG. 17 illustrates an enlarged rear elevational view of the barrel with the drive wheels correctly positioned.
Figure 18:
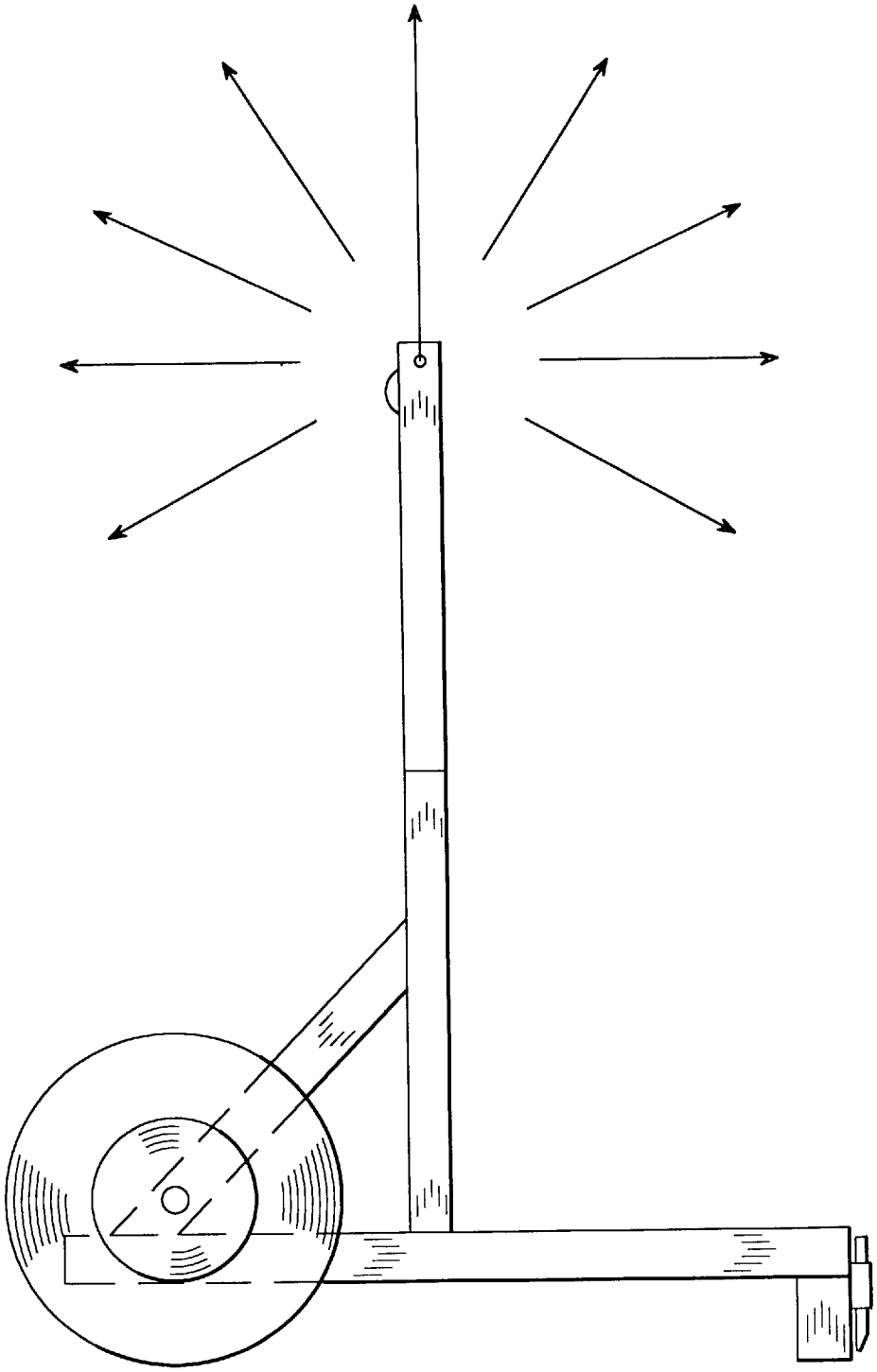
FIG. 18 illustrates the side elevational view of the stand with arrows indicating the range of pitching capabilities of the ball pitching machine.

FIG. 4 is a front elevational view of the ball pitching machine mounted on the two component 400 and 450 fold-down sectional stand. FIG. 5 is a side elevational view of the lower component 450 of the two-piece sectional stand shown in FIG. 4. FIG. 6 is an elevational view of the rear mounting bracket with the barrel ring 405. FIG. 7 is a top plan view of the mounting bracket shown in FIG. 6. FIG. 8 is the mounting bracket attachment to the stand, which includes a bolt, radiused segments, and a friction washer. FIG. 9 is a side view of the upper stand section 400. FIG. 10 is a front view of the upper stand section 400 shown in FIGS. 5 and 9. FIG. 11 is a side view of the present invention including the stand in the transport mode. FIG. 12 is a top plan view of the ball pitching machine mounting bracket showing the U-shaped sections 412 and 414 that fit together with the front ring 420 and rear ring 405 sections. The upper stand 400 is rotationally mounted to the lower stand. It is used to raise or lower the ball pitching machine for use or transport. A locking means is provided to hold the ball pitching machine in the raised position. FIG. 13 is the front mounting ring 420. A pair of opposed sections 421 and 422 extend from the ring 420 and each one slips over the ends of the U-shaped brackets 412 and 414. FIG. 14 is the rear mounting ring. A pair of opposed sections 421 and 422 extend from the ring 420 and each one slips over the ends of the U-shaped brackets 412 and 414. FIG. 15 illustrates front elevational views of the mounting knobs illustrated in FIG. 12. FIG. 16 illustrates the barrel 50. FIG. 17 illustrates an enlarged rear elevational view of the barrel with the drive wheels correctly positioned. FIG. 18 illustrates the side elevational view of the stand with arrows indicating the range of pitching capabilities of the ball pitching machine.

Figure 19:
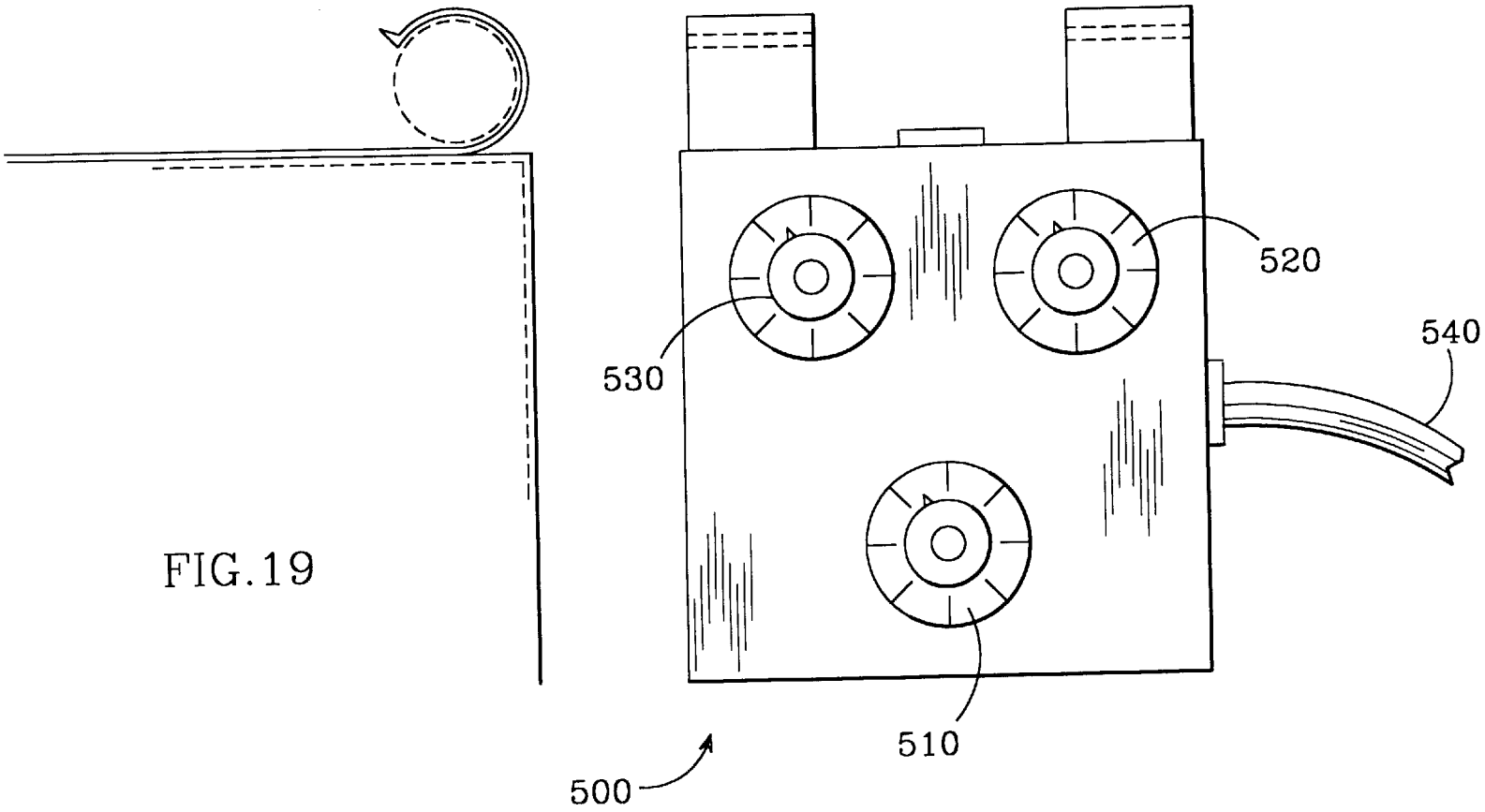
FIG. 19 illustrates the electrical control box with three knobs for adjusting the rotational speed of each of the drive wheels.

FIG. 19 illustrates the electrical control box 500 with three knobs 510, 520, and 530 for adjusting the rotational speed of each of the drive wheels 100, 200, and 300 respectively. The control knobs 510, 520, and 530 can regulate the amount of electricity flowing to each electric motor 105, 205, and 305 respectively. An electrical cord 540 supplies electrical current to the control panel. A timer switch can be placed in the control box to intermittently reduce wheel speed to randomly change the speed of the thrown ball. The rotational speed of each drive wheel is adjustable independently of the speeds of the other two drive wheels. An attachment cord (not shown) extends from the control panel 500 to the ball pitching machine. The control box can be snapped onto the tubular bracket assembly for use. The electrical leads from the three motors form into a male plug for connection to the control box. A demountable control box can serve as a means for the limitation of the use of the machine. The control box can be removed from the machine and locked in a safe place to prevent unauthorized use of the machine.

The present invention can be described as a ball pitching machine having an integral pitching barrel 50 and motor mount 10 and three spaced drive wheels 100, 200, and 300 partially projecting into the barrel to grip and propel a ball placed in one end of the pitching barrel. The barrel 50 has three longitudinally aligned slots or windows in the surface of the barrel 50 to provide clearance for secant portions of each of the three wheels. The planes formed by each drive wheel extend radially from the longitudinal axis of the barrel 50. Each radial plane is equally spaced from each other at 120 degrees relative to each other. Each drive wheel is rotatably mounted on the end of a rotatable drive shaft 110, 210 and 310 of an electric motor. Each domed wheel is secured to the threaded end of the drive shaft with a nut 103, 203, and 303. The three electric motors 105, 205, and 305 are mounted on the integral pitching barrel and mount 10 by C-shaped clamps 115, 215, and 315.

The integral barrel motor mount 10 has three electrical motor supports each extending radially from the axis of the barrel 50. Each motor support is in spaced relationship to each other around the barrel. The feed or input end of the barrel has a circular opening of sufficient diameter to allow a ball to enter. The circular opening of the feed end also has an external cylindrical band or bearing journal 52 larger than and circumjacent and concentric with the circular opening. The cylindrical bearing journal can fit into and mate with the rear support ring 405 found on the stand, and illustrated in FIG. 14. The end of the barrel opposite that of the feed end is labelled the ejectment end of the barrel. The ejectment or output end has a larger diameter circular opening than the circular opening in the feed end. The circular opening of the ejectment end also has an external cylindrical band or bearing journal 53 larger than and circumjacent and concentric with the circular opening. The cylindrical bearing journal can fit into and mate with the front support ring 420 found on the stand, and illustrated in FIG. 13. The front and rear bearing journals in combination with the front and rear support rings on the stand allow the barrel and ball pitching machine to be rotated about its axis. The barrel and integral mount can be supported by the pair of front and rear rings on the stand. The feed end of the barrel has an integrated ball feed and ball guide rails 54 illustrated in FIG. 3 and FIG. 16. This allows the ball to be properly aligned as the ball is grabbed by the three drive wheels. The rotating wheels create a slight vacuum at the feed end, which pulls in the ball into the barrel. FIG. 17 is an enlarged view of the ejectment end of the barrel. The band-like edges of the three drive wheels are clearly shown projecting into the barrel cavity. The space created at the center is sufficient to allow the ball to pass through as the faces of the three wheels grip and propel the ball out of the ejectment end of the barrel.

Each of the three electrical motors includes a cylinder-shaped housing and a rotatable drive shaft extending from one flat circular end. The longitudinal axis formed by each drive shaft is aligned tangentially to the circular surface of the barrel and the longitudinal axis of the barrel. A thick disk-shaped circular drive wheel is centrally mounted on the end of the rotatable shaft of each motor. The disk-shaped circular drive wheel is about nine to twelve inches in diameter and about one to two inches in cylindrical length. The drive wheel has a dome-shaped hub cover and a ring-shaped banded rim. The circumferential surface of the ring-shaped drive wheel rim forms a gripping face for contacting the ball and propelling the ball out of the barrel. This construction is clearly shown in the cutaway portion in FIG. 1. The rotational plane of each drive wheel is parallel to the longitudinal axis of the barrel. The circumference of each drive wheel is radially aligned relative to the longitudinal axis of the barrel. As a result, the face of each rim of the three drive wheels is tangential to the longitudinal axis of the barrel.

Each motor is mounted to the integral barrel motor mount with a clamp that surrounds the a portion of the electrical motor housing. Each of the drive wheels has a bell-shaped cover and is attached to the motor shafts. The face of each drive wheel can grip and propel the ball to be thrown by the machine. A particular combination of the rotational wheel speeds of each one of the three drive wheels can be maintained at a given r.p.m., or increased or decreased within a range to create any useful velocity or trajectory of a pitched ball. The combination of wheel velocities results in a different type of pitch.

While the present invention has been shown and described herein in what is conceived to be the best mode contemplated, it is recognized that departures may be made therefrom within the scope of the invention which is therefore not to be limited to the details disclosed herein, but is to be afforded the full scope of the invention.

I claim:

1. A mechanical ball pitching machine comprising:

an integral barrel and motor mount;

three drive motors mounted to said motor mount;

each said three drive motors having a rotatable shaft;

three reverse hub drive wheels each mounted separately to each said rotatable drive shaft of each of said three motors;

said integral barrel having a feed end, an ejectment end and three longitudinal slots for allowing portions of said reverse hub drive wheels to project into the cavity of said barrel;

support means for providing lateral and elevational rotation of the apparatus through all useful positions while retaining gravitational stability in all positions;

said support means comprises:

a wheel mounted frame;

a generally U-shaped left bracket secured to said frame;

a generally U-shaped right bracket secured to said frame in an opposed facing relationship to said U-shaped left bracket;

a front support ring for rotatably securing said ejectment end of said ball pitching device;

a rear support ring for rotatably securing said feed end of said ball pitching device;

said front support ring and said rear support ring being mounted in a spaced relationship between said first and second opposed facing U-shaped brackets to form a generally open rectangular-shaped support member for rotatably mounting said ball pitching device.

2. The apparatus as recited in claim 1 including:

said drive wheels being controlled by motor speed to create a plurality of ball trajectory choices.

3. The apparatus as recited in claim 1 including:

control panel for adjusting the rotational speeds of said motors and drive wheels.

4. The device as recited in claim 1 further comprising:

a demountable control box, which can be removed from the device and locked in a safe place to prevent unauthorized use of the machine.

* * * * *